US006674631B2

(12) United States Patent
Ward

(10) Patent No.: US 6,674,631 B2
(45) Date of Patent: Jan. 6, 2004

(54) CHARGING DISPENSER FOR A THIN WEB

(76) Inventor: Calvin B. Ward, 9580 Crow Canyon Rd., Castro Valley, CA (US) 94552

( * ) Notice: Subject to any disclaimer, the term of this patent is extended or adjusted under 35 U.S.C. 154(b) by 0 days.

(21) Appl. No.: 09/928,166

(22) Filed: Aug. 6, 2001

(65) Prior Publication Data

US 2003/0026057 A1 Feb. 6, 2003

(51) Int. Cl.[7] ..... H01H 3/00
(52) U.S. Cl. ..... 361/225
(58) Field of Search ..... 361/212, 213, 361/220, 221, 222, 225, 229, 230, 233; 118/620, 621, 623, 624, 625, 638

(56) References Cited

U.S. PATENT DOCUMENTS 3,671,806 A * 6/1972 Whitmore et al. ..... 361/212
6,484,328 B1 * 11/2002 Frazier ..... 4/661

* cited by examiner

*Primary Examiner*—Ronald W. Leja

(57) ABSTRACT

A dispenser having a reservoir for holding a web characterized by a web dielectric constant and a charging station for charging the web by tribocharging when the web is removed from the reservoir. The charging station has a first charging strip includes a first material having a first dielectric constant different from the web dielectric constant and a contact mechanism for pressing web against the charging strip as the web is removed from the reservoir. The contact mechanism may include a second charging strip having a second material with a second dielectric constant different from the web dielectric constant, the web passing between the first and second charging strips.

16 Claims, 2 Drawing Sheets

CHARGING DISPENSER FOR A THIN WEB

FIELD OF THE INVENTION

The present invention relates to tribocharging of webs, and more particularly, to a web dispenser that imparts an electrostatic charge to a web as the web is dispensed.

BACKGROUND OF THE INVENTION

Electrically charged sheets of plastics such as polypropylene are well known in the art. Such sheets are normally created by passing a thin sheet of plastic between two electrodes that impart a charge to the sheet. Such charged sheets are used as a print medium for advertising, and the like, because these sheets will cling to a vertical surface without the aid of glue. In advertising or poster applications, sheets having a deeply imbedded charge that remains for an extended period of time (weeks or months) are preferred. Such sheets are the subjects of a number of U.S. patents. For example, U.S. Pat. Nos. 5,989,685 and 5,904,985 describe printing articles consisting of a sheet of electrically charged plastic connected to a backing sheet that provides stability during the printing process and also increases the lifetime of the charge.

Electrostatically charged plastic sheets are also useful as a "white board" for writing with markers. Sheets of electrostatically charged plastic for use in such applications have been known for some time. For example, U.S. Pat. No. 5,207,581 describes an easel with a roll of electrostatically charged plastic in a dispenser attached to the easel. In this arrangement, a section of charged plastic is withdrawn from the dispenser and sticks on the easel. After the user finishes writing on the easel, the sheet may be removed from the easel and transferred to a wall or other surface where it will stick because the sheet remains charged even after it is removed from one surface and moved to another surface.

Such sheets have also been used as a means for covering a surface to improve the cleanliness of the surface. For example, electrically charged sheets of plastic have been used as a covering on the walls of a clean room. In addition to sealing the walls, the sheets collect dust particles. Accordingly, these sheets improve the quality of the clean room environment. To clean the walls, the sheets are merely removed and replaced with fresh sheets, which requires substantially less work than that required to wash the walls.

These sheets have also been suggested as a protective covering for surfaces. For example, these sheets can be used to cover a portion of the walls in a child's room on which the child wishes to write or draw. When the child is finished, the sheets can be easily removed. Since the sheets are typically made of a plastic such as polypropylene, the underlying wall is protected from the marker fluid.

For such applications to be commercially viable, the cost of the sheets must be quite low. While inexpensive thin film polypropylene sheets are commercially available, the cost of charging the sheets represents a significant fraction of the cost of the final product. When sold in precharged form, the charge must last for a period of time that is much longer than the time the sheet will be on the surface, since the sheets will be in transit or inventory for months, not to mention the time spent in the user's possession prior to actually being dispensed.

If a very high charge is placed on the sheets to extend the shelf life of the product, the sheets may discharge when the user unrolls the material or tries to separate individual sheets from a stack of pre-cut sheets. Such discharges are clearly undesirable as the user may experience electric shocks. Accordingly, charging schemes in which a low intensity electric charge is deeply implanted in the plastic are preferred. Such charging, however, increases the cost of the final product.

Broadly, it is the object of the present invention to provide an improved dispenser for charging webs.

These and other objects of the present invention will become apparent to those skilled in the art from the following detailed description of the invention and the accompanying drawings.

SUMMARY OF THE INVENTION

The present invention is a dispenser having a reservoir for holding a web, characterized by a web dielectric constant, and a charging station for charging the web by tribocharging when the web is removed from the reservoir. The charging station has a first charging strip that includes a first material having a first dielectric constant different from the web dielectric constant and a contact mechanism for pressing web against the charging strip as the web is removed from the reservoir. The contact mechanism may include a second charging strip having a second material with a second dielectric constant different from the web dielectric constant. The web passes between the first and second charging strips in such embodiments. In one embodiment of the invention, the first dielectric constant is greater than the web dielectric constant, and the second dielectric constant is less than the web dielectric constant. In another embodiment of the invention, the first charging strip includes a third material having a dielectric constant different from the first dielectric constant, the first and third materials being arranged as an array of alternating pads such that the web is charged in stripes of alternating polarity as the web is removed from the reservoir. The reservoir preferably includes a box having a lid with a flap that overlies a portion of an outer surface of the box, the first charging strip being located between the flap and the outer surface of the box. The user presses on the flap as the web is dispensed thereby forcing the web against the charging strip. In another embodiment, the first charging strip is located on the outer surface of the box and the second charging strip is located on the flap.

DETAILED DESCRIPTION OF THE INVENTION

The present invention is based on the observation that in many applications, the electrostatically charged sheets do not need to maintain their electrostatic charge for long periods of time once the sheet has been applied to the surface that is to be protected. A period of a few hours is often sufficient. In addition, once the charge is trapped between the sheet and the surface on which the sheet is placed, the charge will only slowly leak off of the sheet. For example, U.S. patent application Ser. No. 09/655,987, which is hereby incorporated by reference, describes an electrostatically charged sheet that is used to protect a work surface while a worker is working on the surface. If the surface is electrically insulated, there is no place for the charge to dissipate even in those cases in which the charge is relatively mobile. In such environments, the sheets are typically removed at the end of the day and discarded. Hence, a short-lived electrical charge would be sufficient for such applications.

The present invention utilizes tribocharging to charge the sheets as the sheets are dispensed. Tribocharging systems utilize mechanical rubbing to impart a static electrical charge to the web. As is well known in the physical arts, when a material having a first dielectric constant rubs against a material having a different dielectric constant, electrons will be transferred from one material to the other. The material having the higher dielectric constant acts as the donor, and hence, becomes positively charged, and the material having the lower dielectric constant becomes negatively charged. For example, when polypropylene sheet is rubbed with wool or nylon, a electrons are transferred from the nylon to polypropylene and the polypropylene becomes negatively charged. The charged sheet will then cling to a surface if placed against the surface. After some time, the charge will leak off of the sheet and the cling will be lost. However, it has been found experimentally that the charge lasts long enough to provide adhesion for a period of hours.

Figures 1, 2:
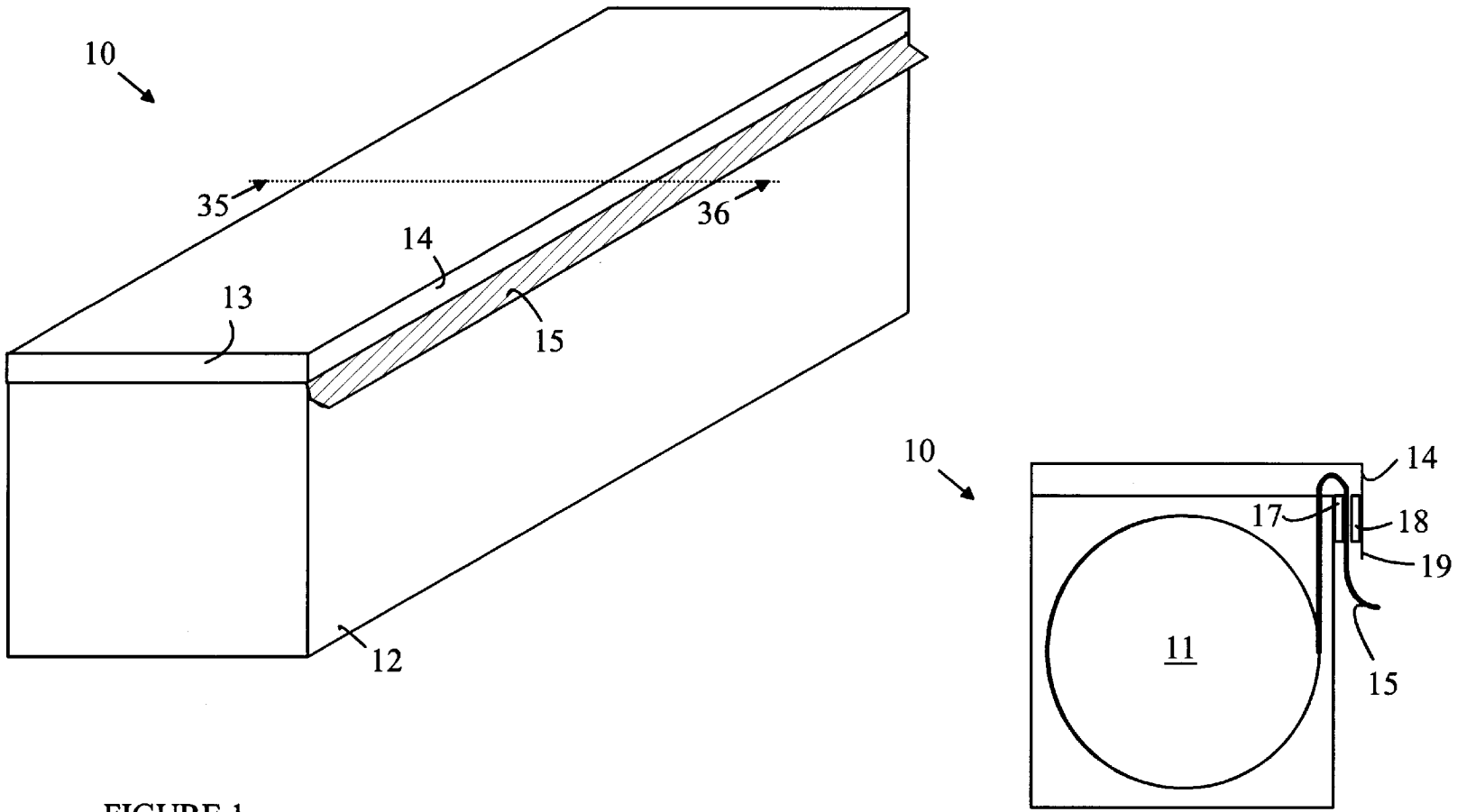
FIGS. 1 and 2 are a prospective view of a dispenser 10 according to the present invention, and a cross-sectional view through line 35–36, respectively.

The present invention is a dispenser that imparts charge to a sheet as the sheet is drawn from a roll of plastic within the dispenser. Refer now to FIGS. 1 and 2, which are a prospective view of a dispenser 10 according to the present invention, and a cross-sectional view through line 35–36, respectively. Dispenser 10 dispenses a plastic film from a roll of film 11 contained within a box 12. The film passes through a charging station comprising surfaces 17 and 18. An end 15 of the sheet of film is grasped by the user and pulled to dispense the film. If the user presses on the flap of the box while dispensing the film, the film will rub against the charging station surfaces. As the film is pulled through surfaces 17 and 18, an electrostatic charge is imparted to the film. When the desired length of film has been dispensed, the film is cut from the roll by causing the film to press against cutter 19.

The preferred plastic film is oriented polypropylene having thickness between 0.1 mils and 5 mils. However, any film that can be charged electrostatically can be utilized. In general, the film material will be influenced by how the film is to be used once the film has been applied to the surface. For example, plastic films are preferred for applications in which the film must act as a barrier to liquids. If the film is to be used to absorb a liquid, paper or plastic having a water absorbent coating can be utilized. Films of polyethylene may also be utilized. Films that are good insulators are preferred, as such films prevent the charge from leaking off by passing through the film and exchanging electrons with the air on the other side of the film.

The material used to impart a charge to the film will, in general, depend on the material from which the film is constructed. In general, the material must have a dielectric constant that is different from that of the film. If the charging material has a dielectric constant that is greater than that of the film, the film will be negatively charged. For polypropylene and polyethylene films, mica, wool, nylon, and polished glass can be utilized can be used as electron donors. While wool is an excellent charging material, wool tends to leave fibers on the charged film. These fibers can pose problems in applications such as food processing. Accordingly, the preferred materials for such applications are non-fibrous or have fibers that are tightly bound to the charging strip.

The charging strips are preferably felt-like in construction. That is, these strips have soft fibers that contact the web as the web is drawn past the charging strips. The fibers assure that good contact is made along the entire length of the web. Pads made from nylons have been found to particular effective for charging polypropylene webs.

Figure 3:
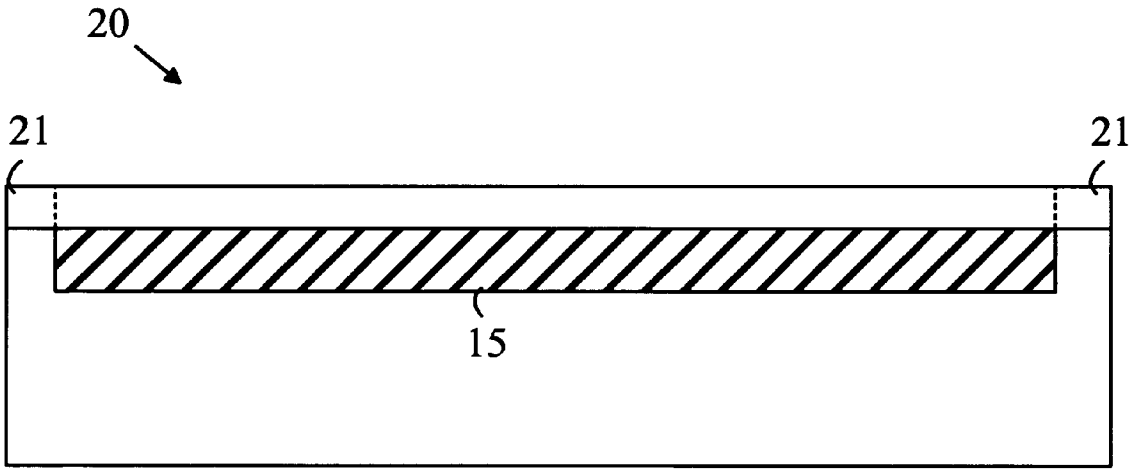
FIG. 3 is a front view of a dispenser 20 according to another embodiment of the present invention.

If a large amount of web is drawn past a charging strip in a short period of time, a substantial electric charge can accumulate on the charging strip. This charge buildup can be substantially reduced by using charging strips made from different materials and providing a path for the flow of charge from one charging strip to the other. For example, consider the case in which a polyvinyl chloride (PVC) film is charged by passing the film between a first charging strip (i.e., charging strip 17 shown in FIGS. 1 and 2) and a second charging strip (charging strip 18), wherein the first charging strip is constructed from a material having a dielectric constant greater than that of the that of PVC, and the second charging strip as a dielectric constant less than that of the PVC. For example, strip 18 can be made from nylon, and strip 17 can be made from Teflon. In this case, one side of the film will be charged positively and the other side of the film will be charged negatively. Similarly, one of the charging pads will be left with a positive charge thereon, and the other charging strip will be left with a negative charge. Referring to FIG. 3, which is a front view of a dispenser 20 according to the present invention, the charging strips are arranged such that the width of the charging strip is larger than the width of the web 15 that is being charged. As a result, the charging strips are in contact with one another in the end regions 21 of the charging strips. If the charging strips are made from a material that has a small conductivity, charge that accumulates on the charging strip will leak to the ends where it will recombine with the opposite charge on the opposing charging strip.

The conductivity of the charging strips can be increased by including a conducting material such as carbon in the bulk material from which the charging strips are formed. Carbon doped plastics of this type are well known in the semiconductor packaging arts where they are used to construct anti-static packaging for semiconductors.

Figure 4:
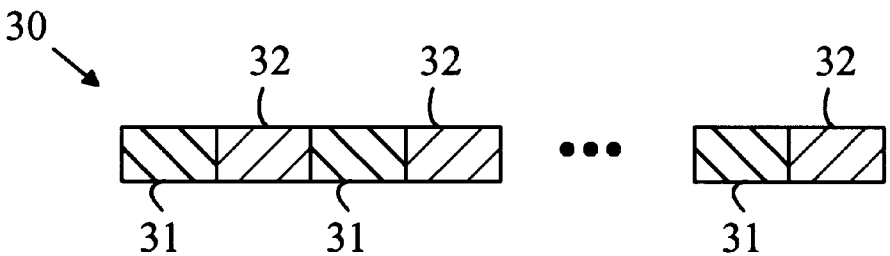
FIG. 4 is top view of a charging strip according to another embodiment of the present invention.

In another embodiment of the invention, the charging strips are constructed from alternating pads of charging material. Refer now to FIG. 4, which is top view of such a charging strip. Charging strip 30 is constructed from two materials shown at 31 and 32. One material has a dielectric constant less than that of the web to be charged, and the other material has a dielectric constant greater than that of the web to be charged. When the web is drawn across charging strip 30, a stripped charge pattern is created on the web. The stripes are adjacent to one another and have opposite charges. If the web is a good insulator, the stripped pattern will persist and cause the web to cling to an insulating surface.

The charge buildup on charging strip 30 is greatly reduced because charge can move from one pad to the next if the pads have a small conductivity. Hence, any charge that accumulates on one pad will be discharged by the opposite charge that has accumulated on the adjacent pads. The charge movement can be facilitated by placing the pads on a conductive backing material so that the undersurfaces of the pads are electrically connected. If the charging pads have substantially different efficiencies for charging the web, the ratio of the areas of the pads can be adjusted so that the positive charge that is accumulated on one pad is more nearly canceled by the negative charge accumulated on the neighboring pad.

Various modifications to the present invention will become apparent to those skilled in the art from the foregoing description and accompanying drawings. Accordingly, the present invention is to be limited solely by the scope of the following claims.

What is claimed is:

1. A dispenser comprising:

a reservoir having a web characterized by a web dielectric constant; and a charging station for charging said web by tribocharging when said web is removed from said reservoir, wherein said charging station comprises:

a first charging strip comprising a first material having a first dielectric constant different from said web dielectric constant; and a contact mechanism for pressing web against said charging strip as said web is removed from said reservoir.

2. A dispenser comprising:

a reservoir having a web characterized by a web dielectric constant; and a charging station for charging said web by tribocharging when said web is removed from said reservoir, wherein said charging station comprises:

a first charging strip comprising a first material having a first dielectric constant different from said web dielectric constant; and a contact mechanism for pressing web against said charging strip as said web is removed from said reservoir, wherein said contact mechanism comprises a second charging strip comprising a second material having a second dielectric constant different from said web dielectric constant, said web passing between said first and second charging strips.

3. The dispenser of claim 2 wherein said first charging strip is pressed against said second charging strip when said web is removed from said reservoir.

4. The dispenser of claim 2 wherein said first dielectric constant is different from said second dielectric constant.

5. The dispenser of claim 4 wherein said first dielectric constant is greater than said web dielectric constant, and said second dielectric constant is less than said web dielectric constant.

6. A dispenser comprising:

a reservoir having a web characterized by a web dielectric constant; and a charging station for charging said web by tribocharging when said web is removed from said reservoir, wherein said charging station comprises:

a first charging strip comprising a first material having a first dielectric constant different from said web dielectric constant; and a contact mechanism for pressing said web against said charging strip as said web is removed from said reservoir, wherein said first charging strip further comprises a third material having a dielectric constant different from said first dielectric constant, said first and third materials being arranged as an array of alternating pads such that said web is charged in stripes of alternating polarity as said web is removed from said reservoir.

7. A dispenser comprising:

a reservoir having a web characterized by a web dielectric constant; and a charging station for charging said web by tribocharging when said web is removed from said reservoir, wherein said charging station comprises:

a first charging strip comprising a first material having a first dielectric constant different from said web dielectric constant; and a contact mechanism for pressing said web against said charging strip as said web is removed from said reservoir, wherein said reservoir comprises a box having a lid with a flap that overlies a portion of an outer surface of said box, said first charging strip being located between said flap and said outer surface of said box.

8. A dispenser comprising:

a reservoir having a web characterized by a web dielectric constant; and a charging station for charging said web by tribocharging when said web is removed from said reservoir, wherein said charging station comprises:

a first charging strip comprising a first material having a first dielectric constant different from said web dielectric constant; and a contact mechanism for pressing said web against said charging strip as said web is removed from said reservoir, wherein said contact mechanism comprises a second charging strip comprising a second material having a second dielectric constant different from said web dielectric constant, said web passing between said first and second charging strips, and wherein said reservoir comprises a box having a lid with a flap that overlies a portion of an outer surface of said box, said first charging strip being located on said outer surface of said box and said second charging strip being located on said flap.

9. A method of charging a web comprising:

providing a reservoir having said web therein; and manually drawing said web through a charging station attached to said reservoir thereby charging said web utilizing tribocharging, wherein said charging station comprises:

a first charging strip comprising a first material having a first dielectric constant different from web dielectric constant; and a contact mechanism for pressing web against said charging strip as said web is removed from said reservoir.

10. A method of charging a web comprising:

providing a reservoir having said web therein; and manually drawing said web through a charging station attached to said reservoir thereby charging said web utilizing tribocharging, wherein said charging station comprises:

a first charging strip comprising a first material having a first dielectric constant different from web dielectric constant; and a contact mechanism for pressing web against said charging strip as said web is removed from said reservoir, and wherein said contact mechanism comprises a second charging strip comprising a second material having a second dielectric constant different from said web dielectric constant, said web passing between said first and second charging strips.

11. The method of claim 10 wherein said first charging strip is pressed against said second charging strip when said web is removed from said reservoir.

12. The method of claim 10 wherein said first dielectric constant is different from said second dielectric constant.

13. The method of claim 12 wherein said first dielectric constant is greater than said web dielectric constant, and said second dielectric constant is less than said web dielectric constant.

14. A method of charging a web comprising:

providing a reservoir having said web therein; and manually drawing said web through a charging station attached to said reservoir thereby charging said web utilizing tribocharging, wherein said charging station comprises:

a first charging strip comprising a first material having a first dielectric constant different from web dielectric constant; and a contact mechanism for pressing said web against said charging strip as said web is removed from said reservoir, and wherein said first charging strip further comprises a third material having a dielectric constant different from said first dielectric constant, said first and second materials being arranged as an array of alternating pads such that said web is charged in stripes of alternating polarity as said web is removed from said reservoir.

15. A method of charging a web comprising:

providing a reservoir having said web therein; and manually drawing said web through a charging station attached to said reservoir thereby charging said web utilizing tribocharging, wherein said charging station comprises:

a first charging strip comprising a first material having a first dielectric constant different from web dielectric constant; and a contact mechanism for pressing said web against said charging strip as said web is removed from said reservoir, and wherein said reservoir comprises a box having a lid with a flap that overlies a portion of an outer surface of said box, said first charging strip being located between said flap and said outer surface of said box.

16. A method of charging a web comprising:

providing a reservoir having said web therein; and manually drawing said web through a charging station attached to said reservoir thereby charging said web utilizing tribocharging, wherein said charging station comprises:

a first charging strip comprising a first material having a first dielectric constant different from said web dielectric constant; and a contact mechanism for pressing said web against said charging strip as said web is removed from said reservoir, wherein said contact mechanism comprises a second charging strip comprising a second material having a second dielectric constant different from said web dielectric constant, said web passing between said first and second charging strips, and wherein said reservoir comprises a box having a lid with a flap that overlies a portion of an outer surface of said box, said first charging strip being located on said outer surface of said box and said second charging strip being located on said flap.

* * * * *

UNITED STATES PATENT AND TRADEMARK OFFICE

CERTIFICATE OF CORRECTION

PATENT NO. : 6,674,631 B2
DATED : January 6, 2004
INVENTOR(S) : Ward

It is certified that error appears in the above-identified patent and that said Letters Patent is hereby corrected as shown below:

Title page,
Item [57], ABSTRACT,
Line 5, insert -- that -- between "strip" and "includes"
Line 7, insert -- the -- between "pressing" and "web"

Column 2,
Line 23, insert -- the -- at the beginning of line before "web against"
Line 52, insert -- a -- between "is" and "top"

Column 3,
Line 17, insert -- a -- between "when" and "polypropylene"
Line 18, delete "a" between "nylon" and "electrons"
Line 19, insert -- the -- between "to" and "polypropylene"
Line 42, insert -- a -- between "ing" and "thickness"
Line 61, delete "can be utilized" after "glass"

Column 4,
Line 6, replace "particular" with -- be particularly -- at beginning of sentence
Line 18, delete "that of" after "that of the"
Line 19, replace "as" after "strip" with -- has --
Lines 50 and 52, replace "stripped" with -- striped --

Column 5,
Lines 16 and 27, insert -- said -- between "pressing" and "web"

Column 6,
Lines 39 and 50, insert -- said -- between "from" and "web"
Lines 41 and 52, insert -- said -- between "pressing" and "web"

UNITED STATES PATENT AND TRADEMARK OFFICE

CERTIFICATE OF CORRECTION

PATENT NO. : 6,674,631 B2
DATED : January 26, 2004
INVENTOR(S) : Ward

It is certified that error appears in the above-identified patent and that said Letters Patent is hereby corrected as shown below:

Column 7,
Lines 8 and 28, insert insert -- said -- between “from” and “web”

Signed and Sealed this

Third Day of August, 2004

JON W. DUDAS
*Acting Director of the United States Patent and Trademark Office*